US005166984A

United States Patent [19]

Hsiao

[11] Patent Number: 5,166,984

[45] Date of Patent: Nov. 24, 1992

[54] LOUDSPEAKER

[76] Inventor: Yu-Teng Hsiao, No. 697, Pei She Wei, Pei Hu Lu, Chia I, Taiwan

[21] Appl. No.: 788,514

[22] Filed: Nov. 6, 1991

[51] Int. Cl.[5] ..... H04R 25/00

[52] U.S. Cl. ..... 381/199; 381/192; 381/194; 381/200

[58] Field of Search ..... 381/194, 199, 201, 192, 381/200

[56] References Cited

U.S. PATENT DOCUMENTS 4,336,425 6/1982 Renkus ..... 381/199

4,608,463 8/1986 Burgess et al. ..... 381/199

*Primary Examiner*—Jin F. Ng

*Assistant Examiner*—Huyen D. Le

*Attorney, Agent, or Firm*—Morton J. Rosenberg; David I. Klein

[57] ABSTRACT

A loudspeaker comprising a T-shaped disc, a magnetic iron disc, a disc-shaped base, a voice coil, and a cone-shaped diaphragm, the two discs and the base having air holes to communicating with one another after being assembled together, the T-shaped disc being able to be rotated to change the position of its air holes to communicate with the air holes in the magnetic disc and the base in various degrees to change the volume of the air compressed by the diaphragm to flow through the holes.

2 Claims, 4 Drawing Sheets

LOUDSPEAKER

BACKGROUND OF THE INVENTION

A conventional loudspecker shown in FIG. 8 comprises a T-shaped disc 1, a magnetic iron disc 2 fixed in the inner edge of the T-shaped disc 1, a circular base 3 having an annular flat portion 31 on which is welded the T-shaped disc 1, a voice coil 4, and a cone-shaped diaphragm 5 as its main components.

The circular base 3 also has four trapezoidal openings 32 equally spaced around, and a terminal plate 33 with two terminals for connecting lead wires for the voice coil 4, which is provided between a gap between the protruding-down post and the central opening of the annular flat portion 31 of the circular base 3. The cone-shaped diaphragm 5 is fixed at the outside of the coil 4 and then a protective ring 6 is placed on the central portion of the cone-shaped diaphragm 5.

When the coil 4 receives an alternate current signal, the polar magnetic field between the coil 4 and the magnetic iron 2 produces corresponding magnetic alteration to directly move the voice coil 4, which then moves the diaphragm 5 to vibrate to compress the air around, and the trapezoidal openings 32 serves as air passages for air pressed by the vibration of the diaphragm, thus performing the function of a loudspeaker.

However, the trapezoidal openings 32 is pre-set inadjustable in the conventional art, impossible to realize the reproduced voice as turly as the original voice.

SUMMARY OF THE INVENTION

The loudspeaker in the present invention has been devised to have the air passage for air compressed by the cone-shaped diaphragm changable in its dimension in various degrees to obtain the best result in making the diaphragm to vibrate to compress air to be absorbed through the air passage formed by holes bored in a T-shaped disc, a magnetic disc and a disc-shaped base and communicating with one another.

DETAILED DESCRIPTION OF THE INVENTION

Figure 1:
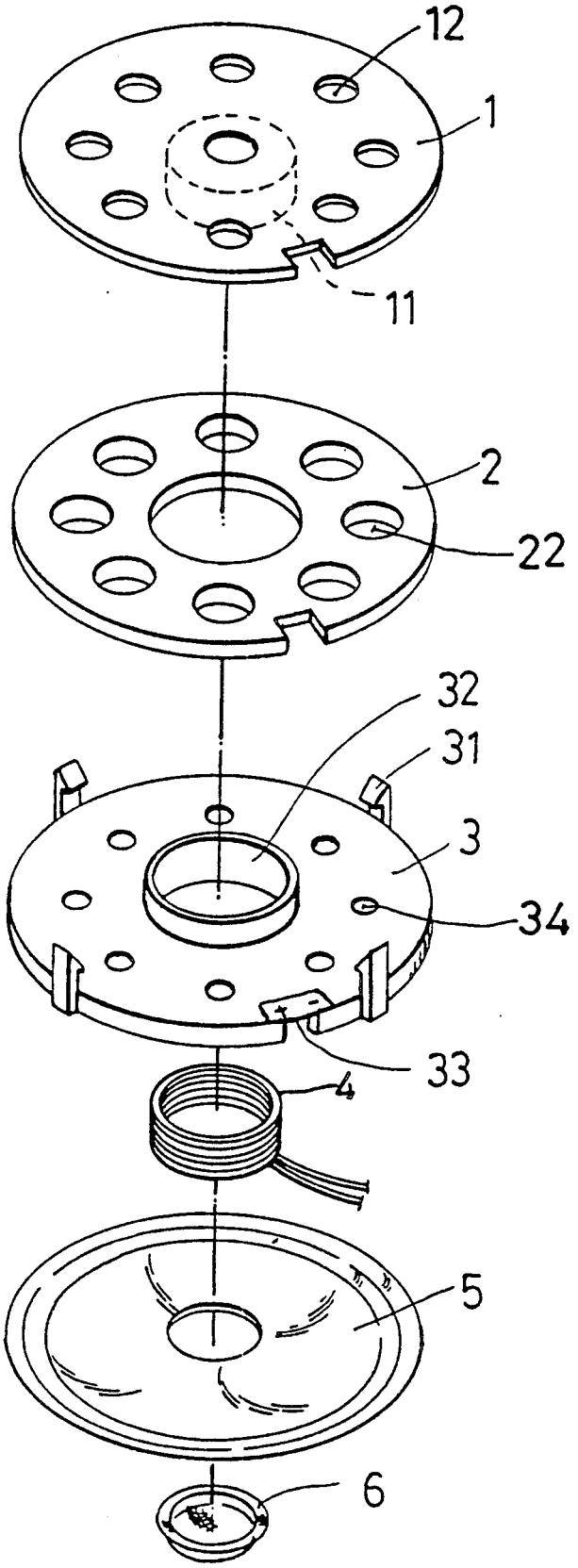
FIG. 1 is an exploded perspective view of the loudspeaker in the present invention.

The loudspeaker in the present invention, as shown in FIG. 1, comprises a T-shaped disc 1, a magnetic iron disc 2, a disc-shaped base 3, a voice coil 4, and a cone-shaped diaphragm 5 as its main components.

The T-shaped disc 1 has a projecting-down cylindrical post 11 at the center to rotatably fit in a central opening surrounded by a connecting ring 32 of the disc-shaped base 3, and a plurality of air holes 12 equally spaced apart around its body and located to coordinate with air holes 22 in the magnetic iron disc 2 and air holes 34 in the disc-shaped base 3, and a notch 11 in the circumferential edge to coordinate with a notch in the magnetic iron disc 2 and in the disc-shaped base 3.

The magnetic iron disc iron disc 2 has a central opening to fit around the connecting ring 32 of the disc-shaped base 3 and is positioned on the upper surface of the disc-shaped base 3 and under the T-shaped disc 1. The magnetic iron disc 2 also has a notch in the circumferential edge and the same number of air holes 22 as that of the T-shaped disc 1, the air holes 22 are so located that they coordinate with the air holes 34, and the notch coordinates with the notch in the disc-shaped base 3.

The disc-shaped base 3 has a connecting ring 32 in its center, the same number of air holes 34 as the air holes 12 in the T-shaped disc 1 equally spaced apart around its body, a number of upright cuniform fasteners 31 equally spaced apart on the circumferential edge to hold in order the T-shaped disc 1 and the magnetic iron disc 2 on its upper surface, and a notch in the circumferential edge to fix a terminal plate 33 thereon. The disc-shaped base 3 and the magnetic iron disc 2 are to be bound together stably and immovably with an adhesive, with the air holes 22 and 34 facing one another and the notches in the both 2, 3 facing each other.

The voice coil 4 is made in a cylindrical shape and is to be positioned in a gap between the outer surface of the projecting post 11 of the T-shaped disc 1 and the connecting ring 32 of the disc-shaped base 3 and its two ends of wires glued on the surface of the cone-shaped diaphragm 5 and then connected with the terminals on the terminal plate 33.

The cone-shaped diaphragm 5 is provided to position at the outside of the disc-shaped base 3 by means of a coil protective ring 6 on the center of the diaphragm and attached to the voice coil 4 to be moved thereby.

When the voice coil 4 receives alternating current after the speaker has been assembled together, a changing magnetic field is produced between the coil 4 and the magnetic iron disc 2. This field interacts with the field from the magnetic iron disc 2 to produce reciprocal forces to move the coil 4 physically attached to the cone-shaped diaphragm 5, which is then to be vibrated by the movement of the coil 4 to produce sound waves in the air.

Figure 3:
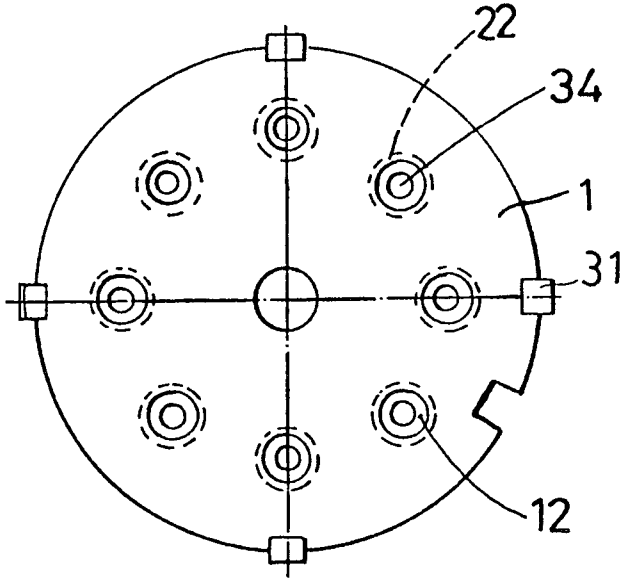
FIG. 3 is an upper view of the loudspeaker in the present invention.
Figure 2:
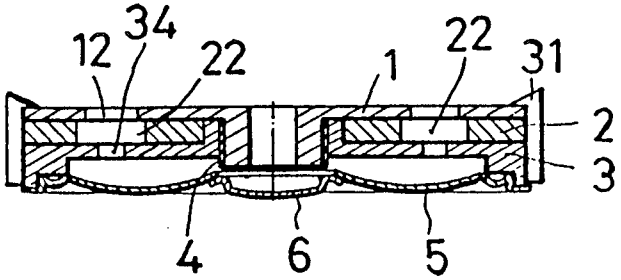
FIG. 2 is a side cross-sectional view of the loudspeaker in the present invention.

Now, if the air holes 12 in the T-shaped disc 1 are adjusted to position to face and communicate completely with the air holes 22 in the disc 2 and the air holes 34 in the base 3, then the absorbed volume of the air compressed by the diaphragm 5 is the largest, so the voice produced is also the loudest so that even a very feeble singal can be turly vibrated out, as shown in FIG. 3.

Figure 4:
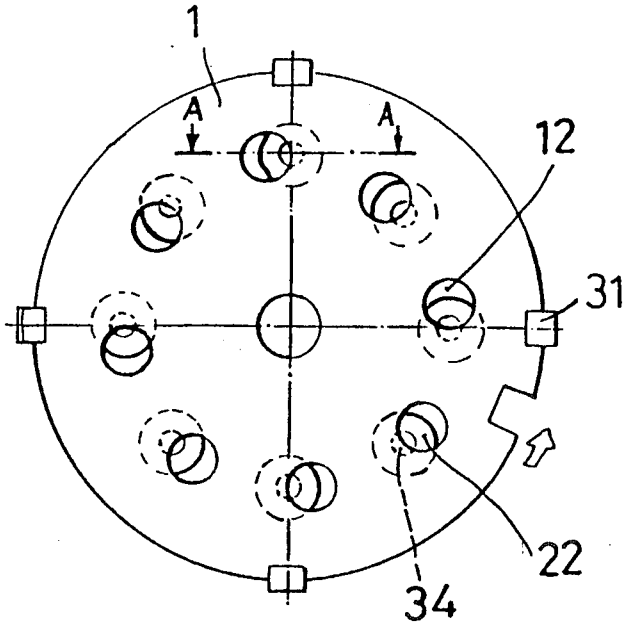
FIG. 4 is a planar view of the air holes in the T-shaped disc in relation with the air holes in the magnetic iron disc and the disc-shaped base and a magnified view of A—A line.
Figure 4A:
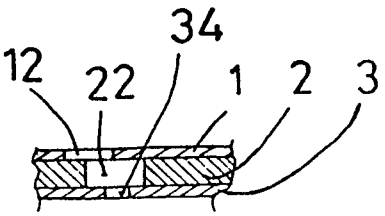

If the air holes 12 in the T-shaped disc 1 are adjusted to position not in complete communication with the air holes 22 and 34, the absorbed volume of the air compressed by the diaphragm 5 can be reduced according to the distance separated from each other, and thus the voice produced can also be reduced in its loudness, as shown in FIG. 4.

Figure 5:
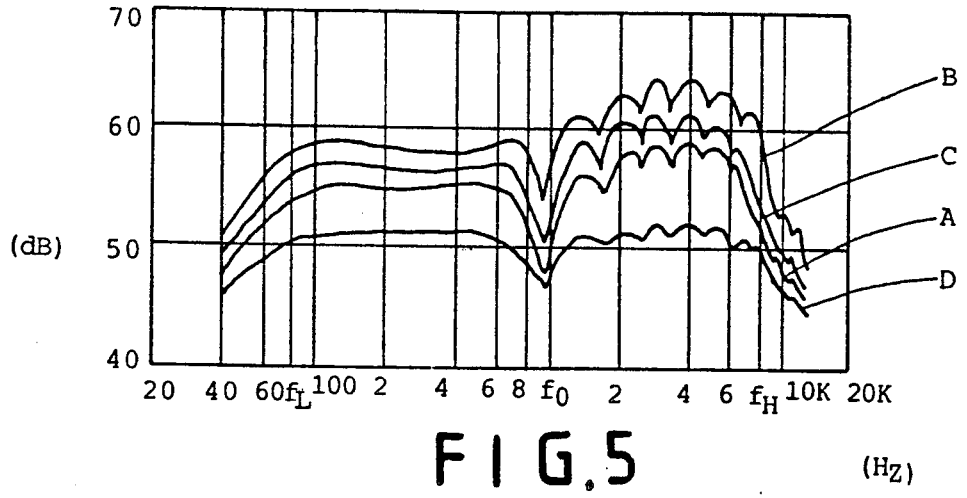
FIG. 5 is a characteristic graph of voice intensity vs frequency of a conventional loudspeaker and the loudspeaker in the present invention.

FIG. 5 shows the characteristic graph of sound intensity vs. frequency, wherein Line A is that of a conventional loudspeaker, Line B that of the air holes 12 adjusted to communicate with the air holes 22 and 34 in the largest dimension in the present invention, Line C that of the holes 12 adjusted to communicate with the holes 22 and 34 in the medium dimension, and Line D that of the holes 12 adjusted to communicate with the holes 22 and 34 in the smallest dimension. It can be seen from the graph in FIG. 5 that Line B and C are better than Line A in the sensibility of the speakers, i.e. the average voice intensity produced at a point one meter far away from the center of the speakers when 1 watt electric power is given to the speakers. Line D is evidently the worst, even worse than Line A, because of very little volume of the compressed air flowing through those air holes 12, 22, and 34 communicating with each other in the least dimension.

Figure 6:
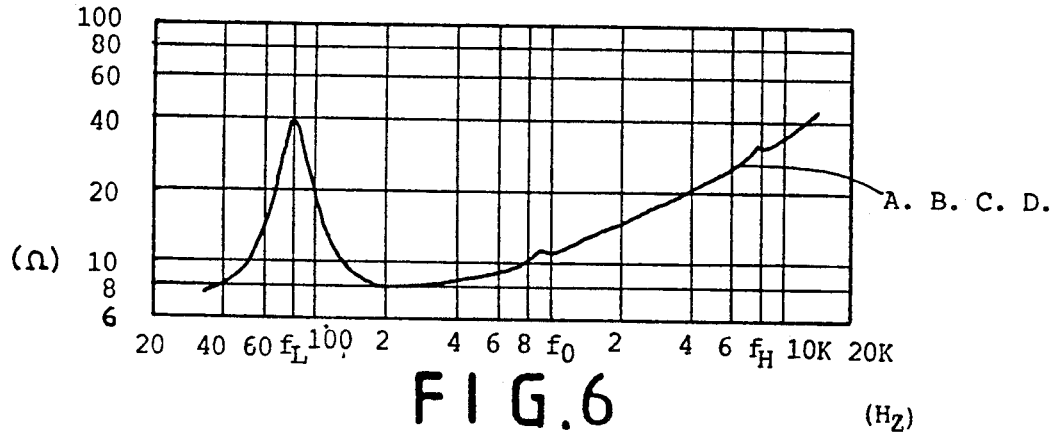
FIG. 6 is a characteristic graph of the coil resistance vs frequency of a conventional loudspeaker and the loudspeaker in the present invention.

FIG. 6 shows the characteristic graph of resistance in the coil vs. frequency, wherein all Lines A, B, C, D are in a line because of the similarity of their characteristics that the resistance of the voice coil 4 is almost not affected by the air volume flowing through the holes 12, 22, 34.

Figure 7:
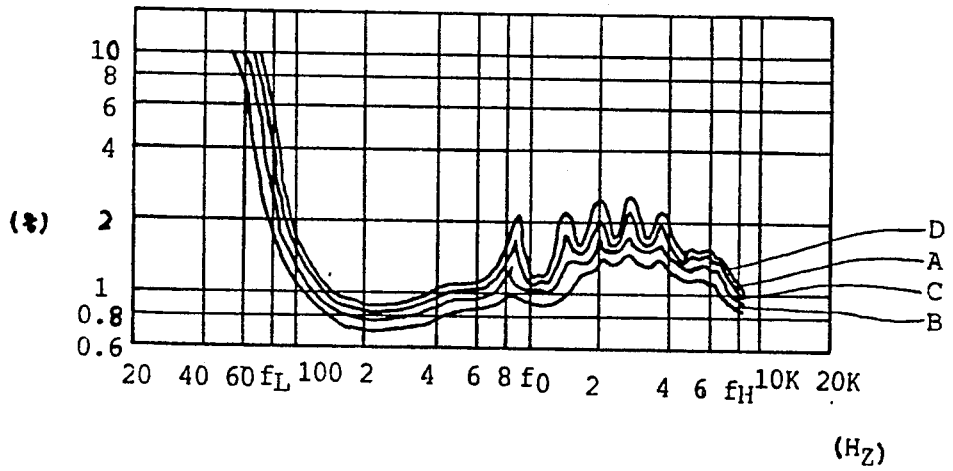
FIG. 7 is a characteristic graph of distortion vs frequency of a conventional loudspeaker and the loudspeaker in the present invention.
Figure 8:
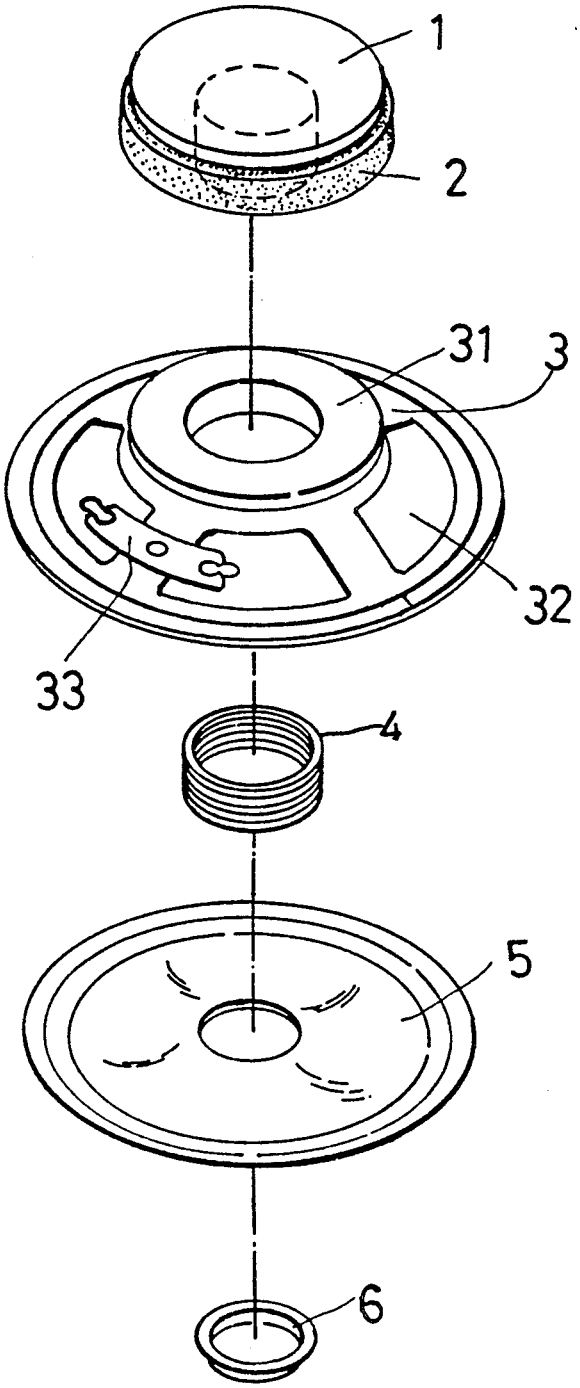
FIG. 8 PRIOR ART
FIG. 8 is an exploded perspective view of a conventional loudspeaker.

FIG. 7 shows the characteristic graph of distortion vs. frequency, and said distortion is distortion percentage of wavelength under a difinite voltage of the input. The higher the distortion percentage is, the less true the quality of voice reprodused is. Lines B and C are better than Line A, as compressed air can flow through the holes 12, 22, 34 in an even dispersed way and thus the disphragm 5 gives out air pressure on its whole surface in the similar way. Consequently the quality of the the voice reproduced by the speaker can be indirectly improved. But Line D is worse than Line A, because of very little volume of compressed air flowing through the air holes 12, 22, 34.

What is claimed is:

1. A loudspeaker comprising;

a T-shaped disc having a projecting-down cylindrical post and a plurality of round air holes equally spaced apart around in its body;

a magnetic iron disc having a central hole to fit around a connecting ring in the center of a disc-shaped base and said magnetic iron disc having the same number of air holes as the air holes in the T-shaped disc to communicate with each other;

a disc-shaped base having a connecting ring at its center and the same number of air holes as the air holes in the magnetic iron disc, said connecting ring having a central opening to be received the projecting post of the T-shaped disc, said disc-shape base having its upper surface in contact with the lower surface of the magnetic iron disc, said air holes in the disc-shaped base communicating with the air holes in the magnetic iron disc, said base and the magnetic iron disc being held together tightly;

a voice coil of a cylindrical shape positioned in a gap between the projecting post and the connecting ring in the disc-shaped base;

a cone-shaped diaphragm positioned at the outside of the disc-shaped base and attached to the voice coil, said cone-shaped diaphragm to be moved by the coil; and said T-shaped disc positioned on the magnetic iron disc and able to be rotated to adjust its position in relation with said magnetic iron disc so that its air holes can communicate in various degrees with the air holes in the magnetic iron disc and the disc-shaped base so as to change the volume of the air compressed to flow through them by the vibration of the cone-shaped diaphragm.

2. The loudspeaker as claimed in claim 1, wherein said disc-shaped base is provided with a plurality of upright cuneiform fasteners on the circumferential edge for holding securely in position the T-shaped disc, the magnetic iron disc on the disc-shaped base.

* * * * *